United States Patent [19]

Kral

[11] Patent Number: 4,579,089

[45] Date of Patent: Apr. 1, 1986

[54] STEAM GENERATOR, ESPECIALLY A CONTINUOUS FLOW STEAM GENERATOR

[75] Inventor: Rudolf Kral, Langensendelbach, Fed. Rep. of Germany

[73] Assignee: Kraftwerk Union Aktiengesellschaft, Mülheim, Fed. Rep. of Germany

[21] Appl. No.: 720,048

[22] Filed: Apr. 4, 1985

Related U.S. Application Data

[63] Continuation of Ser. No. 431,626, Sep. 30, 1982, abandoned.

[30] Foreign Application Priority Data

Nov. 25, 1981 [DE] Fed. Rep. of Germany ..... 3146742

[51] Int. Cl.[4] ..... F22B 37/24

[52] U.S. Cl. ..... 122/510; 122/493; 165/82

[58] Field of Search ..... 122/510, 511, 512, 235 R, 122/235 A, 493; 165/81, 82, 160, 162

[56] References Cited

U.S. PATENT DOCUMENTS 3,896,874 7/1975 Bongaards et al. ..... 165/82
4,000,720 1/1977 Lieb et al. ..... 122/510
4,123,994 11/1978 Gersch et al. ..... 122/510
4,246,872 1/1981 Skinner et al. ..... 122/512

FOREIGN PATENT DOCUMENTS 0012787 7/1980 European Pat. Off. ..... 122/512
1409943 10/1975 United Kingdom ..... 122/512

OTHER PUBLICATIONS

Publication "VGB Kraftwerkstechnik 58", No. 9, Sep. 1978, p. 636, by J. Merz and G. Schürholz

*Primary Examiner*—Albert J. Makay
*Assistant Examiner*—Steven E. Warner
*Attorney, Agent, or Firm*—Herbert L. Lerner; Laurence A. Greenberg

[57] ABSTRACT

Steam generator including a combustion chamber having a combustion chamber wall being formed of welded-together tubes and having an outer surface, cross beams disposed on the outer surface of the wall, a partition beam being longitudinally movably supported at one of the cross beam and being extended across the combustion chamber, a partition suspended from the partition beam in the combustion chamber, and support bands being attached to the cross beams and having upper ends being fastened to the outer surface of the combustion chamber wall.

8 Claims, 4 Drawing Figures

STEAM GENERATOR, ESPECIALLY A CONTINUOUS FLOW STEAM GENERATOR

This application is a continuation of application Ser. No. 431,626, filed Sept. 30, 1982, now abandoned.

The invention relates to a steam generator, especially a continuous-flow steam generator, including a combustion chamber which has a combustion-chamber wall formed by welded-together tubes, in which a partition is disposed which is suspended from a partition beam disposed in a combustion-chamber cross section, and a cross beam being associated with each partition beam and having its ends on the outside of the combustion chamber wall.

Such a steam generator is known from FIG. 6 on page 636 of the publication "VCB Kraftwerkstechnik 58", No. 9, September 1978. In this known steam generator, the partition is formed by two tube walls disposed at a distance from each other. The partition beam is rigidly fastened to the cross beams. The cross beams are in turn suspended by constant suspensions from support tubes which are fastened to an external steam generator frame.

The constant or fixed suspensions are sets of springs which are constructed for a very specific weight of the partition. This weight of the partition, however, does not remain constant. The weight can increase, for instance, particularly because of ash deposition on the partition or because of a different water content in the partition, and it can also decrease. The constant suspensions do not take up the differences between the respective actual weight of the partition and the partition weight for which they are constructed; rather, these weight differences lead to mechanical stresses at the junctions between the partition and the combustion chamber wall, where they can lead to damage to the combustion chamber wall and to the partition.

It is accordingly an object of the invention to provide a steam generator, especially a continuous-flow steam generator, which overcomes the hereinafore-mentioned disadvantages of the heretofore-known devices of this general type, and to prevent such mechanical stresses caused by changes of the weight of the partition at the junctions between the combustion chamber wall and the partition.

With the foregoing and other objects in view there is provided, in accordance with the invention, a steam generator, comprising a combustion chamber having a combustion chamber wall being formed of welded-together tubes and having an outer surface, cross beams disposed on the outer surface of the wall, a partition beam being longitudinally movably supported at one of the cross beam and being extended across or in a cross section of the combustion chamber, one cross beam being associated with each partition beam, a partition suspended from the partition beam in the combustion chamber, and support bands being attached to the cross beams and having upper ends being fastened to the outer surface of the combustion chamber wall.

This structure allows differences of the actual weight of the partition and a predetermined starting weight to be transmitted by the cross beams and the support bands to the combustion chamber wall and the differences need not be taken up by the junctions between the combustion chamber wall and the partition. Therefore, even changes in the weight of the partition cannot cause mechanical stresses at these junctions.

A uniform distribution of the partition weight over the combustion chamber wall is achieved if, in accordance with another feature of the invention, the length and/or the cross section of the support bands of each cross beam are equal, so that each of the support bands transmits substantially the same weight or force to the combustion chamber wall with the upper ends of the support bands.

In accordance with a further feature of the invention, at least three of the support bands are attached to and distributed over the length of each of the cross beams. In this way, the forces caused by the weight of the partition are distributed over several points of the combustion chamber wall.

In accordance with an added feature of the invention, there are provided tie rods fastened to the outer surface of the combustion chamber wall, the upper ends of the support bands each being welded to one of the tie rods.

In accordance with an additional feature of the invention, the closer the support bands are to the center of a respective one of the cross beams, the smaller are the cross sections thereof.

In accordance with again another feature of the invention, the closer the support bands are to the center of a respective one of the cross beams, the larger are the lengths thereof.

In accordance with a concomitant feature of the invention, there is provided a roller bearing supporting the partition beam on the cross beams.

Other features which are considered as characteristic for the invention are set forth in the appended claims.

Although the invention is illustrated and described herein as embodied in a steam generator, especially a continuous-flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
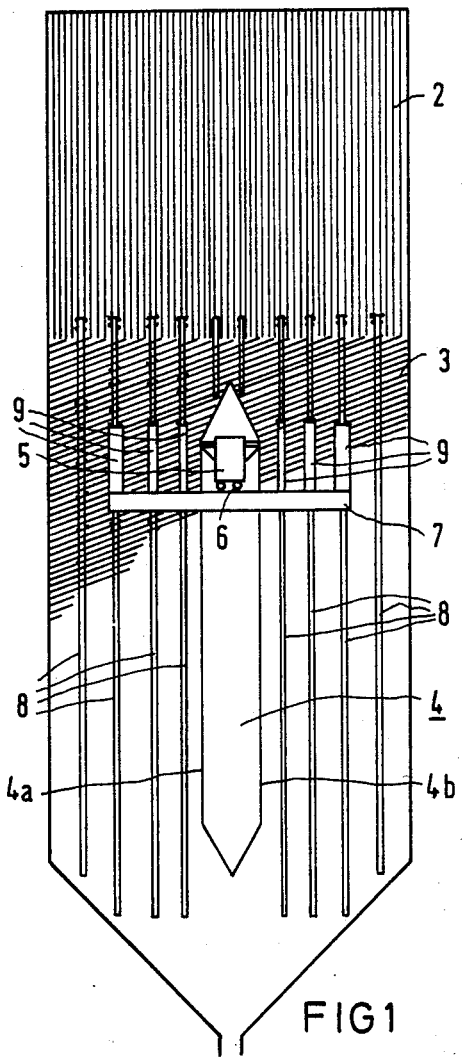
FIG. 1 is a diagrammatic side-elevational view of the first embodiment of a continuous-flow steam generator according to the invention.

Referring now generally to the continuous-flow steam generators according to FIGS. 1 to 4, it is seen that they include a combustion chamber with a diaphragm wall as the combustion chamber wall, which is constructed from fin tubes that are welded to each other at the fins, and is suspended from a non-illustrated external steam generator frame. An upper part 2 of the combustion chamber wall is equipped with vertical tubes, and a lower part 3 of this combustion chamber wall is equipped with inclined tubes. Within the combustion chamber, in the combustion chamber part which is formed by the lower part 3 of the combustion chamber wall and is equipped with inclined tubes, there is a partition 4. The partition 4 includes two tube walls 4*a* and 4*b* which are disposed at a distance from each other and are likewise in the form of a diaphragm wall of fin tubes which are welded together. The tube walls 4*a* and 4*b* are connected to each other at their upper and lower edges, forming a space between the two tube walls 4*a* and 4*b*.

The partition 4 with its tube walls 4*a* and 4*b* is connected to the inclined tube part 3 of the combustion chamber wall. The partition 4 is suspended from a partition beam 5 which is disposed in a cross section of the combustion chamber between the two tube walls 4*a* and 4*b*. Each end of the partition beam 5 rests on the outside of the combustion chamber with the interposition of an antifriction bearing formed of a ball bearing 6, on the center of a cross beam 7 which is disposed outside the combustion chamber and is transverse to the partition beam 5.

Figure 2:
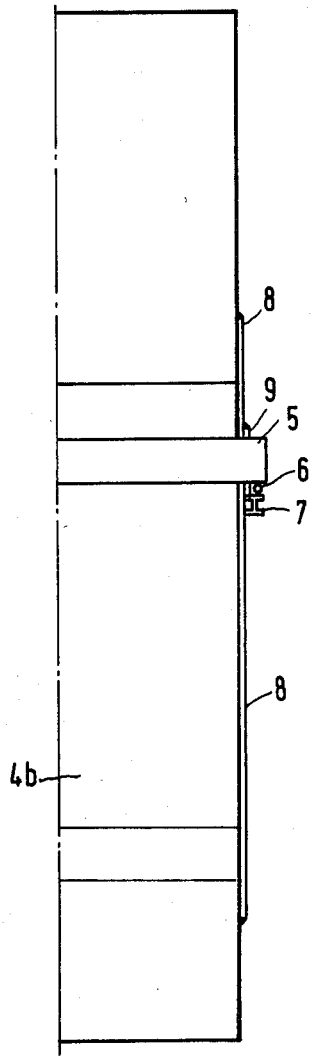
FIG. 2 is a longitudinal-sectional view through the condinuous-flow steam generator according to FIG. 1.

In the embodiment according to FIGS. 1 and 2, vertical tie rods 8 made of steel are attached to the outside of the combustion chamber wall. The tie rods 8 are welded with their upper ends to the part 2 of the combustion chamber wall having vertical tubes and they are welded to a multiplicity of points at the part 3 of the combustion chamber wall. Three vertical support bands 9 are attached to the upper surface of the cross beams 7, and are uniformly distributed over the length of the cross beams 7, on each side of the center of the cross beams 7. The vertical support bands 9 are made of steel and are welded with their upper ends to respective tie rods 8.

All of the support bands 9 have the same initial length, but the closer they are to the center of the cross beams 7, the smaller are their cross sections.

In order to determine the elongation of the support bands 9 caused by the weight of the partition 4, Hooke's law applies: $\Delta L = P\alpha L/F$, where $\Delta L$ is the length difference, $1/\alpha$ is the modulus of elasticity, L is the initial length, F is the initial cross section of the respective support band 9, and P is the tension force which attacks the support band 9 and originates from the weight of the partition 4. Under the weight of the load of the partition 4 resting in the center of the cross beams 7, the cross beams 7 are deflected downward. Since the initial length L is the same for all of the support bands 9, the cross sections F of the individual support bands 9 disposed at the respective cross beam 7 are matched to each other in such a way that the length changes L corresponding to the deflection of the cross beams 7 correspond to equal tension forces P caused by the weight of the partition 4 in all of the support bands 9. This means that each of the six support bands 9 disposed at each cross beam 7 transmits the same load force P into the part 2 of the combustion chamber wall with vertical tubes, caused by the weight of the partition 4, i.e., the combustion chamber wall is loaded uniformly by the weight of the partition 4. Weight changes of the partition 4 are likewise transmitted uniformly to the combustion chamber wall. The weight changes do not lead to mechanical stresses at the joints between the combustion chamber wall and the partition 4.

Figure 3:
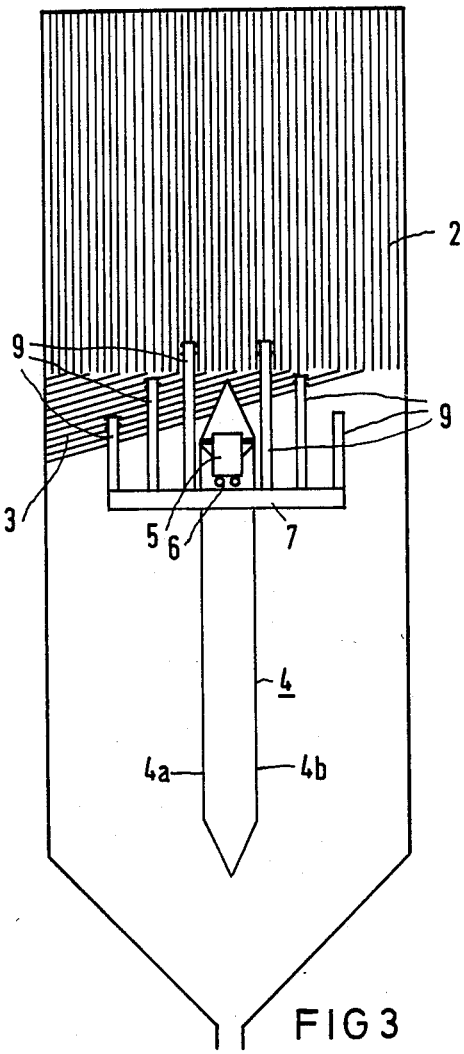
FIG. 3 is a side-elevational view of a second embodiment of a continuous-flow steam generator according to the invention.
Figure 4:
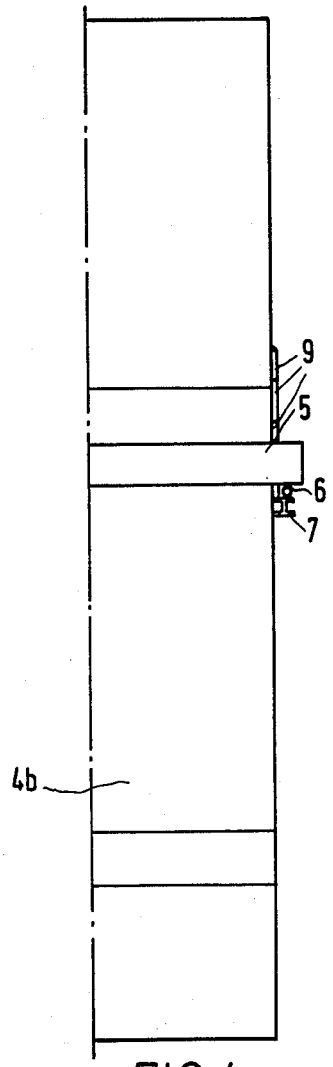
FIG. 4 is a longitudinal-sectional view through the continuous-flow steam generator according to FIG. 3.

In the embodiment of the continuous-flow steam generator according to the invention shown in FIGS. 3 and 4, six respective vertical support bands 9 made of steel are likewise attached in such a way as to be uniformly distributed over the length of the cross beams 7, on the upper surface thereof. The support bands 9, three of which are disposed on each side of the center of the cross beams 7, all have the same cross section F in this embodiment. The support bands are welded directly with their upper ends partially to the outside of the part 2 with vertical tubes and partially to the outside of the part 3 of the combustion chamber wall with the inclined tubes. The closer support bands 9 are to the center of the cross beams 7, the greater is the initial length thereof.

Since all of the support bands 9 have the same cross section in this case, their lengths L are matched to each other so that the length differences $\Delta L$ of the individual support bands 9, which correspond to the deflection of the cross beams 7 by the load of the partition 4, correspond to the same tension force P caused by the weight of the partition 4 for all of the support bands 9, according to Hooke's law. It is likewise ensured thereby that the weight of the partition 4, as well as changes of this weight, are transmitted uniformly by the support bands 9 to the combustion chamber wall of the continuous-flow steam generator, and do not lead to mechanical stresses at the junction points between the combustion chamber wall and the partition 4.

The foregoing is a description corresponding to German Application No. P 31 46 742.3, dated Nov. 25, 1981, the International priority of which is being claimed for the instant application, and which is hereby made part of this application. Any discrepancies between the foregoing specification and the aforementioned corresponding German application are to be resolved in favor of the latter.

I claim:

1. Steam generator, comprising a combustion chamber having a combustion chamber wall being formed of welded-together tubes and having an outer surface, cross beams disposed on said outer surface of said wall, a partition beam having two ends, each of said ends being longitudinally movably supported at a respective one of said cross beams and being extended across said combustion chamber, a partition being connected to said combustion chamber wall and being suspended from said partition beam in said combustion chamber, and support bands being attached to said cross beams and having upper ends, said support bands being fastened to said outer surface of said combustion chamber wall only at said upper ends thereof, at least three of said support bands being attached to each of said cross beams and distributed over the length of each of said cross beams, and said support bands having cross sections increasing gradually in size in direction from the center of each respective one of said cross beams toward the ends thereof.

2. Steam generator according to claim 1, wherein the cross-sectional areas of said support bands attached to a given cross beam are proportioned to each other so that substantially the same weight is supported by said combustion chamber wall at each of said support bands.

3. Steam generator according to claim 1, including tie rods fastened to said outer surface of said combustion chamber wall, said upper ends of said support bands each being welded to one of said tie rods.

4. Steam generator according to claim 1, including a roller bearing supporting said partition beam on said cross beams.

5. Steam generator, comprising a combustion chamber having a combustion chamber wall being formed of welded-together tubes and having an outer surface, cross beams disposed on said outer surface of said wall, a partition beam having two ends, each of said ends being longitudinally movably supported at a respective one of said cross beams and being extended across said combustion chamber, a partition being connected to said combustion chamber wall and being suspended from said partition beam in said combustion chamber, and support bands being attached to said cross beams and having upper ends, said support bands being fastened to said outer surface of said combustion chamber wall only at said upper ends thereof, at least three of said support bands being attached to each of said cross beams and distributed over the length of each of said cross beams, and said support bands having lengths decreasing in size in direction from the center of each respective one of said cross beams toward the ends thereof.

6. Steam generator according to claim 5, wherein the lengths of said support bands attached to a given cross beam are proportioned to each other so that substantially the same weight is supported by said combustion chamber wall at each of said support bands.

7. Steam generator according to claim 5, including tie rods fastened to said outer surface of said combustion chamber wall, said upper ends of said support bands each being welded to one of said tie rods.

8. Steam generator according to claim 5, including a roller bearing supporting said partition beam on said cross beams.

* * * * *